US010060184B2

(12) United States Patent
Chu

(10) Patent No.: US 10,060,184 B2
(45) Date of Patent: Aug. 28, 2018

(54) LOOPED ZEBRA BLIND WITH HEIGHT COMPENSATION AND HEIGHT COMPENSATION METHOD OF THE SAME

(71) Applicant: Chen-Ho Chu, Taipei (TW)

(72) Inventor: Chen-Ho Chu, Taipei (TW)

( * ) Notice: Subject to any disclaimer, the term of this patent is extended or adjusted under 35 U.S.C. 154(b) by 87 days.

(21) Appl. No.: 14/903,490

(22) PCT Filed: Aug. 29, 2014

(86) PCT No.: PCT/CN2014/000805
§ 371 (c)(1),
(2) Date: Jan. 7, 2016

(87) PCT Pub. No.: WO2015/043107
PCT Pub. Date: Apr. 2, 2015

(65) Prior Publication Data

US 2016/0145937 A1 May 26, 2016

(30) Foreign Application Priority Data

Sep. 30, 2013 (CN) ..... 2013 1 0461284

(51) Int. Cl.
*A47H 1/00* (2006.01)
*E06B 9/24* (2006.01)
(Continued)

(52) U.S. Cl.
CPC ..... *E06B 9/24* (2013.01); *A47H 15/00* (2013.01); *A47H 23/02* (2013.01); *A47H 23/06* (2013.01);
(Continued)

(58) Field of Classification Search
CPC ..... E06B 9/24; E06B 209/2405; E06B 2009/2458; E06B 9/40; E06B 9/42; A47H 23/06
See application file for complete search history.

(56) References Cited

U.S. PATENT DOCUMENTS 2,142,822 A 1/1939 Moore
2,280,358 A 4/1942 Tietig
(Continued)

FOREIGN PATENT DOCUMENTS

CN 2793277 Y 7/2006
CN 2862893 Y 1/2007
(Continued)

*Primary Examiner* — Katherine W Mitchell
*Assistant Examiner* — Jeremy C Ramsey
(74) *Attorney, Agent, or Firm* — Muncy, Geissler, Olds & Lowe, P.C.

(57) ABSTRACT

A looped zebra blind with height compensation and a height compensation method of the same are revealed. The looped zebra blind includes an upper rod, a lower rod and a height compensable looped fabric. The looped fabric consists of a zebra fabric part and at least one compensation part connected to form a loop wound around the upper and lower rods vertically. The loop includes a front fabric and a rear fabric with the same height. The zebra fabric part includes zebra fabric units arranged vertically and periodically. The net length or/height of the compensation part is preset to make total length of the looped fabric become equal to the sum of the total length of the zebra fabric part and the net length of the compensation part. Thereby the height of the front/rear fabric matches up to the preset height of a preset covered area of a window.

11 Claims, 9 Drawing Sheets

(51) Int. Cl.

| | |
|---|---|
| ***A47H 15/00*** | (2006.01) |
| ***A47H 23/06*** | (2006.01) |
| ***A47H 23/02*** | (2006.01) |
| ***E06B 9/40*** | (2006.01) |
| ***E06B 9/388*** | (2006.01) |
| ***E06B 9/42*** | (2006.01) |

(52) U.S. Cl.
CPC ..... *E06B 9/388* (2013.01); *E06B 9/40* (2013.01); *E06B 9/42* (2013.01); *A47H 2023/025* (2013.01); *E06B 2009/2405* (2013.01); *E06B 2009/405* (2013.01)

(56) References Cited

U.S. PATENT DOCUMENTS

| | | | | |
|---|---|---|---|---|
| 2,384,377 | A | 9/1945 | Holstein | |
| 6,189,592 | B1 * | 2/2001 | Domel | E06B 9/24 160/241 |
| 7,174,940 | B2 | 2/2007 | Nien | |
| 7,207,371 | B2 | 4/2007 | Hsu | |
| 7,267,156 | B2 * | 9/2007 | Byeon | E06B 9/40 160/121.1 |
| 7,438,115 | B2 | 10/2008 | Bohlen | |
| 7,806,160 | B2 | 10/2010 | Byeon | |
| 8,646,509 | B2 * | 2/2014 | Chu | E06B 9/24 160/123 |
| 9,587,429 | B2 * | 3/2017 | Cheng | E06B 9/40 |
| 2006/0021713 | A1 * | 2/2006 | Hsu | E06B 9/40 160/85 |
| 2009/0229768 | A1 | 9/2009 | Cheng | |
| 2012/0000617 | A1 | 1/2012 | Chu | |
| 2012/0043029 | A1 | 2/2012 | Gaskill et al. | |

FOREIGN PATENT DOCUMENTS

| | | | |
|---|---|---|---|
| CN | 201786222 | U | 4/2011 |
| DE | 20 2007 008 111 | U1 | 10/2007 |
| EP | 1 512 829 | A1 | 3/2005 |
| EP | 2402544 | A2 | 1/2012 |
| EP | 2402544 | A3 | 3/2012 |
| FR | 2.195.749 | A1 | 3/1974 |
| GB | 926663 | A | 5/1963 |
| GB | 2 253 000 | A | 8/1992 |
| NL | 7114389 | A | 4/1973 |
| WO | WO 2007/085533 | A1 | 8/2007 |

* cited by examiner

LOOPED ZEBRA BLIND WITH HEIGHT COMPENSATION AND HEIGHT COMPENSATION METHOD OF THE SAME

BACKGROUND OF THE INVENTION

The present invention relates to a zebra blind, especially to a looped zebra blind with height compensation and a height compensation method of the same. The looped zebra-stripe blind includes an upper rod, a looped fabric and a lower rod. The looped fabric consists of a zebra-stripe blind part and a compensation part for height compensation connected to each other to form a loop wound around the upper rod and the lower rod. The loop has a front fabric and a rear fabric with the same height and disposed correspondingly to each other. Thereby the height of the front/rear fabric matches up to the preset height of certain area of a window that is going to be covered after the height compensation. The window is covered completely.

A zebra-stripe blind is a kind of window covering. The zebra blinds includes a zebra-striped fabric having alternate see-through parts and opaque parts used in combination with other components such as loading mechanism so as to form a front fabric and a rear fabric moved in relation to each other. For example, a roller type zebra blind revealed in U.S. Pat. No. 6,189,592 and U.S. Pat. No. 7,267,156 includes at least one roller in an upper track (upper frame) used to load a zebra-striped fabric. Refer to US Pat. App. No. 20120000617 and EP 11 171 809.4, a sliding panel type zebra blind including at least one upper track and a plurality of carrier tracks that are slidably extended or folded in parallel. The carrier tracks are disposed under the upper track and each carrier track is loaded with a zebra-striped fabric. While in use, users can move the front fabric and the rear fabric by operation mechanism such as chain disclosed in U.S. Pat. No. 6,189,592 and U.S. Pat. No. 7,267,156 or by their hands such as looped zebra blind disclosed in US2012/0000617 being pulled manually. The overlapped content between the opaque parts and the see through parts can be adjusted by the front fabric and the rear fabric being moved in relation to each other. For example, a see-through state is formed when the see-through parts of the front/rear fabric are completely corresponding to and overlapped with each other. On the other hand, a shaded state is formed once the see-through parts and the opaque parts of the front/rear fabric are completely corresponding to and overlapped with each other. When only a part of the see-through parts and the opaque parts of the front/the rear fabric are corresponding to and overlapped with each other to form different degrees of transparency or opacity. Thereby transparency of the zebra blind is able to be adjusted.

Moreover, the zebra blind of the present invention includes a real zebra blind with patterns looks like strips of zebra and blinds with patterns similar to zebra stripes and the like. Refer to U.S. Pat. No. 6,189,592, U.S. Pat. No. 726,715, US2012/0000617, and DE 20 2007 008111 U1, the zebra blind revealed is formed by a plurality of zebra stripe units arranged vertically and periodically. Each zebra stripe unit (the height is represented by Hu) includes a see through part (whose height is represented by Hs) and an opaque part (whose height is represented by Hb) adjacent to each other. The height Hb of the opaque part is larger than the height Hs of the see through part (Hb>Hs). In a common zebra blind, the Hb=7.5 cm and Hs=5 cm. As to blinds with similar patterns revealed in GB2,253,000 or FR 2 195 749A1, the blinds are nor formed by zebra stripe units arranged periodically and vertically, as shown in FIG. 1 and Page 2 in specification of GB2,253,000. The blind in GB2,253,000 is not having the same structure as the zebra fabric of the present invention and is considered as the like. Yet these two types can both be considered as zebra fabric in the present invention.

In the field of blinds/curtains, there are many techniques related to zebra-stripe fabric available now. According to the operation way or the state of use, the blinds are divided into two main types with details in followings.

The first is a roller-type zebra blind, as shown in JP1995-189,573, U.S. Pat. No. 6,189,592, U.S. Pat. No. 7,267,156, U.S. Pat. No. 2,142,822, U.S. Pat. No. 2,280,358, U.S. Pat. No. 2,384,377, U.S. Pat. No. 7,207,371, U.S. Pat. No. 7,174,940, U.S. Pat. No. 7,267,156, U.S. Pat. No. 7,438,115, US2009/0229768, and U.S. Pat. No. 7,806,160. The zebra-stripe fabric used in the roller-type zebra blind is not a loop. Take the zebra blind revealed in U.S. Pat. No. 7,267,156 as an example. The two ends of the zebra-strip fabric are respectively form a winding rod end (winding rod 114 in FIG. 5) and a fixing piece end (fixing piece 121 and seating groove 120-1 in FIG. 5). A lift and roll mechanism (as adjusting cord/lift mechanism 116 in figures) is used to lift or lower the zebra-stripe fabric. While in use, the zebra-stripe fabric (front and rear fabric) is driven by the rotating winding rod end to move upward or downward. Thus the front fabric and the rear fabric are moved relatively to each other so as to adjust the overlapping between see-through parts and opaque parts of the front fabric and the rear fabric.

The second type is looped type zebra blind, as disclosed in US2012/0000617, GB2,253,000, DE 20 2007 008111 U1, FR 2 195 749A1, NL 7 114 389 A, EP 11 171 809.4, and WO 2007/085533 (PCT/EP2007/050265). The looped type includes two groups-full-looped group and semi-looped group. In US2012/0000617, DE 20 2007 008111 U1, and EP 11 171 809.4, the zebra-stripe fabric used is wound around an upper rod and a lower rod to form an endless loop. As to the semi-looped zebra-stripe fabric disclosed in GB2,253,000 and WO 2007/085533 (PCT/EP2007/050265), the zebra-stripe fabric is also wound around an upper rod and a lower rod but the two ends of the zebra-stripe fabric are mounted into a keyway or a groove on a top surface of the upper rod. The keyway is represented by number 7 in FIG. 1 of GB2,253,000 while the groove is represented by number 18 in FIG. 1 and FIG. 1A of WO 2007/085533.

Compared with the roller type, the looped type zebra-stripe blind has a simpler structure with regard to structure design and/or number of components used. The operation way, usage and components of the roller type blinds have been fixed and restricted. The looped type zebra-stripe blinds have more variety of uses and operation ways available. Take the looped zebra blind revealed in EP 11 171 809.4 as an example. This zebra blind is not only used as a panel of sliding panels (as shown in FIG. 1 to FIG. 9) but also used in combination with a hook and a curtain rod to form a curtain (as shown in FIG. 10 and FIG. 11). The looped type zebra blinds have more applications and higher efficiency. It can be used not only as a blind but also as a room-separating device.

However, the looped type zebra blinds have a significant shortcoming while in use. The looped type zebra blind is formed by a loop of zebra-stripe fabric having see-through parts and opaque parts with preset height and arranged in an alternating manner. For example, the height of the see-through part is 5 cm (Hs=5 cm) while the height of the opaque part is 7.5 cm (Hb=7.5 cm). One see-through part and the adjacent opaque part form a basic blind unit (zebra stripe unit) whose height is represented by Hu. Thus Hu=Hs+Hb=5 cm+7.5 cm=12.5 cm. The looped zebra-stripe fabric is used in combination with other components such as loading mechanism or operation mechanism to form a whole zebra blind disposed on an outer edge or inner edge of a window frame according to design requirements. Thus the looped zebra-stripe fabric covers a preset covered area of the window correspondingly. The height of the preset covered area of the window is represented by Hw. Generally, Hw is a bit smaller than the total height of the window. The preset height of the preset covered area Hw is obtained by the height of other components of the whole zebra-stripe blind such as upper track or lower tract being deducted from the total height of the window. When the zebra-stripe blind is disposed on an inner edge of the window frame as shown in FIG. 1, the preset height Hw is given by the height of other components of the zebra-stripe blind such as track or an upper rod (501, 50 in FIG. 1) and/or a bottom rod (60 in FIG. 1) being deducted from the original height of the window. The original height of the window in user's house is predetermined and the height of other components of the zebra-stripe blind is also preset. Thus the preset height Hw is also able to be considered as predetermined.

The looped zebra-striped fabric of the blind is formed by a plurality of basic blind units (Hu) mentioned above. When the height Hu of the blind unit is 12.5 cm, the total length of the looped zebra-striped fabric should be a multiple of the height of the height Hu (12.5 cm) of the blind unit. For example, a looped zebra-striped blind is formed by a number of $N_0$ ($N_0$=40) blind units. Thus total length of the looped zebra-striped fabric, represented by $L_0$, is 500 cm. ($L_0$=Hu×$N_0$=12.5 cm×40=500 cm). Due to the looped fabric wound around an upper rod and a lower rod, a front fabric and a rear fabric connected to each other and having the same height $H_{f/r}$ are formed. Without considering the length of the looped zebra-striped fabric in contact and wound around the upper rod and the lower rod (the diameter of the upper rod/lower rod is quite small), the height $H_{f/r}$ of the front and the rear fabric is nearly a half of the total length $L_0$ (500 cm) of the looped zebra-striped fabric. $H_{f/r}=L_0\div2$=500 cm÷2=250 cm. Thus the preset height Hw is limited and equal to $H_{f/r}$ (250 cm). In practice, it is impossible that the preset height Hw of the window of the user's house is just the same as the height $H_{f/r}$ of the front and the rear fabric given by the above calculation (250 cm). That means Hw doesn't match up to a half length of a multiple of the height Hu (12.5 cm) of the blind unit. For example, the preset height Hw is 245 cm (Hw=245 cm). When the $H_{f/r}$ is 250 cm, there is an extra length of 5 cm and a part (the extra length) of the looped zebra-striped fabric will lay down on the lower edge of the window or on the ground. This affects the appearance of the front/rear fabric or the whole zebra-stripe blind. In order to prevent the above problem, the total length of the looped zebra-striped fabric is shortened. For example, the looped zebra-striped fabric is formed by a number of $N_0-1$ blind units. Thus total length of the looped zebra-striped fabric $L_0$ is 487.5 cm ($L_0$=Hu×($N_0$−1)=12.5 cm×(40−1)=487.5 cm). Thus $H_{f/r}=L_0\div2$=487.5 cm÷2=243.75 cm. Yet $H_{f/r}$ is 1.25 cm shorter than the preset height Hw=245 cm. That means the front/rear fabric is unable to match up to the preset height and cover the preset covered area completely. There is an uncovered area with the height of 1.25 cm formed on the bottom of the window. This causes negative effects on the appearance of the front/rear fabric or the whole zebra-stripe blind.

Moreover, during manufacturing of the looped type zebra-striped fabric, especially full-looped/endless looped type revealed in US2012/0000617, DE 20 2007 008111 U1, and EP 11 171 809.4, the looped type zebra-striped fabric is usually formed by an even-number multiple of the blind units (with the height Hu) for increasing the durability and lifetime and providing better opacity/shading adjustment. Thereby the height $H_{f/r}$ of the front/rear fabric is a whole-number multiple of the height Hu (12.5 cm) of the blind unit. For example, when the height Hu of the blind unit is 12.5 cm (Hs5 cm+Hb7.5 cm=Hu12.5 cm), the total length $L_0$ of the looped type zebra-striped fabric is set as an even-number multiple of the height Hu of the blind unit. $L_0$=Hu×$N_0$. $N_0$ is an even-number such as 40, 38, 36, etc. Without considering the length of the looped type zebra-striped fabric wound around the upper rod and the lower rod (the diameter of the upper rod and the lower rod is quite small), the height $H_{f/r}$ of the front/rear fabric is about a half of the total length $L_0$ of the looped type zebra-striped fabric. $H_{f/r}=L_0\div2$=(Hu×$N_0$)÷2. Due to that $N_0$ is an even-number such as 40, 38, 36, etc, the height $H_{f/r}$ of the front/rear fabric is a whole-number multiple of the height Hu of the blind unit (12.5 cm).

Thus it is learned that during the manufacturing and uses of the looped type zebra-stripe shade/blind revealed in DE 20 2007 008111 U1, EP 11 171 809.4, GB2,253,000, or WO 2007/085533 (PCT/EP2007/050265), the problem of the height of the front/rear fabric unable to match up to the preset height of the preset covered area will occur. This causes trouble and inconvenience during manufacturing and in use. Thus the applications of the looped type zebra-stripe shade are restricted.

Furthermore, the sliding panel is a kind of conventional blind. Take a sliding panel 5 shown in FIG. 1 to FIG. 4 as an example. The sliding panel 5 includes a rail 501, a plurality of carrier tracks 502 (only one carrier track in FIG. 1) disposed under the rail 501 and a plurality of panels 503 each of which is attached to and hanging on one carrier track 502 (only one panel in FIG. 1). Two separated connectors 504 are arranged at a top surface of each carrier track 502 and each connector 504 is connected to a runner 505 such as roller. By the connector 504 passing through an opening 507 of a channel 506 on the bottom of the rail 501, the runner 505 slides in the channel 506 of the rail 501. Thus each carrier track 502 and the panel thereof 503 is sliding horizontally to be extended gradually for shading the window. Or the carrier tracks 502 and the panel thereof 503 are retracted and overlapped to allow the window to be seen.

In addition, the curtain is a conventional design. Take a curtain 6 shown in FIG. 5 and FIG. 6 as an example. The curtain 6 consists of a rail 601, at least one curtain fabric 602 and at least two hooks 603, and a curtain rod 604. The curtain fabric 602 is arranged adjacent to the rail 601. By the hooks 603, the rail 601 and the curtain fabric 602 is hooked on the curtain rod 604 on top of the window.

SUMMARY OF THE INVENTION

Therefore it is a primary object of the present invention to provide a looped zebra blind with height compensation and a height compensation method of the same while the looped zebra blind is for covering a window. The looped zebra blind includes an upper rod disposed on or close to an upper edge of the window, a lower rod arranged at or close to a lower edge of the window and corresponding to the upper rod vertically, and a looped zebra fabric for covering a preset covered area of the window. The looped zebra fabric is formed by a zebra fabric part and at least one compensation part to form a loop. The zebra fabric part includes a plurality of zebra fabric units arranged periodically and vertically while the loop wound around the upper rod and the lower rod to form a front fabric and a rear fabric with the same height, arranged vertically and corresponding to each other. Each zebra fabric unit includes a see-through segment and an opaque segment with proper height and adjacent to each other. The at least compensation part forms an opaque area. The net length of the compensation part can be calculated and predetermined. Thus the total length of the connected looped fabric is equal to the sum of the length of the zebra fabric part and the net length of the at least compensation part. And the height of the front/rear fabric is almost equal to a half of the total length of the looped fabric. Thus after height compensation the height of the front/rear fabric matches up to the preset height of the preset covered area of the window. When the front fabric or the rear fabric is pulled upward or downward, the overlapping between the see-through segments and the opaque segments of the front and the rear fabric is adjusted by the synchronous movement between the front fabric and the rear fabric after height compensation, without changing the height of the front and the rear fabric. Thus the opacity of the looped zebra blind in relative to the window is adjusted.

It is another object of the present invention to provide a height compensation method of a height compensable looped zebra blind. The method includes following steps. Step 1: Measuring a preset height (Hw) of a preset covered area of a window. Step 2: Providing a looped zebra blind as mentioned above. Step 3: Calculating and setting the net length Lc of the compensation part so as to make the total length of a looped fabric of the looped zebra blind become equal to the sum of the total length of a zebra fabric part of the looped zebra blind and the net length Lc of the compensation part. Thus the net height of front fabric and rear fabric matches up to the preset height Hw after height compensation. Step 4: Connecting the compensation part with the net length Lc and the zebra fabric part having a plurality of zebra fabric units arranged vertically and periodically so as to form the looped fabric with a looped structure. Step 5: Winding the looped fabric around to an upper rod and a lower rod vertically to form the front fabric and the rear fabric having the same height and corresponding to each other and the preset height Hw. Thus a height compensable looped zebra blind is produced.

DETAILED DESCRIPTION OF THE PREFERRED EMBODIMENT

The structure and technical features of the present invention are described in details by following embodiments.

Figure 3:
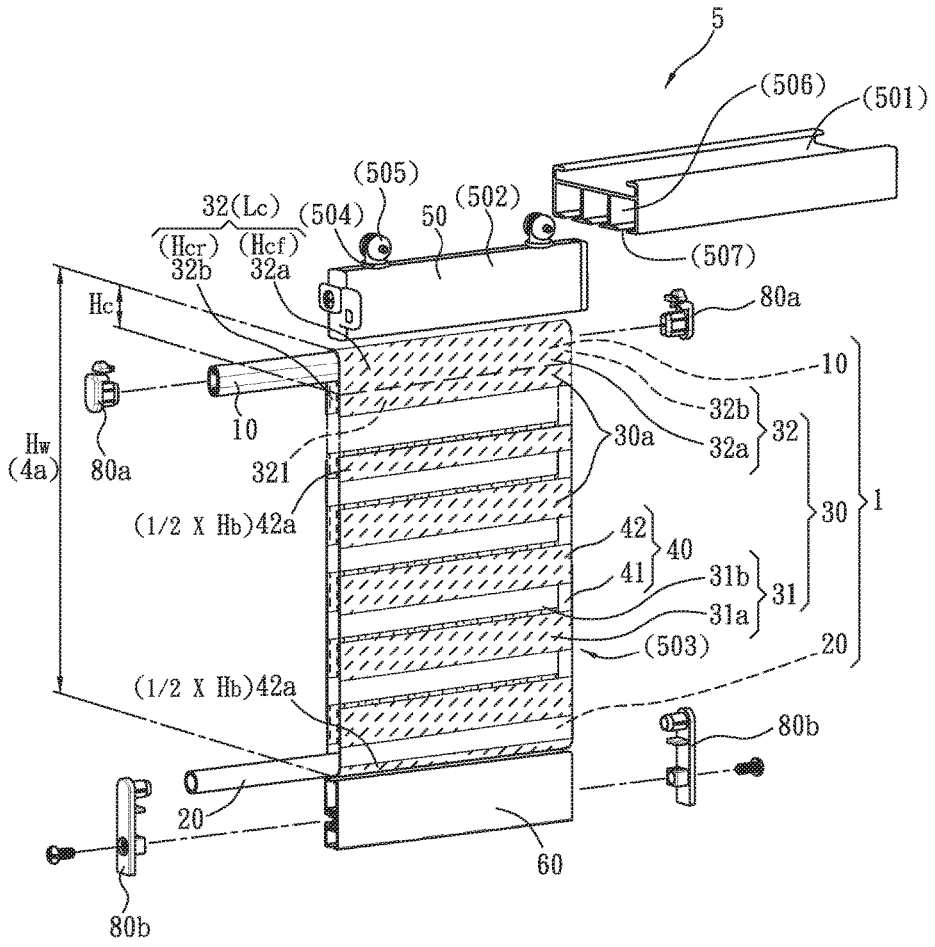
FIG. 3 is an explosive view of an embodiment applied to a sliding panel and having a compensation part wound around an upper rod and separated from a zebra fabric part according to the present invention.
Figure 4:
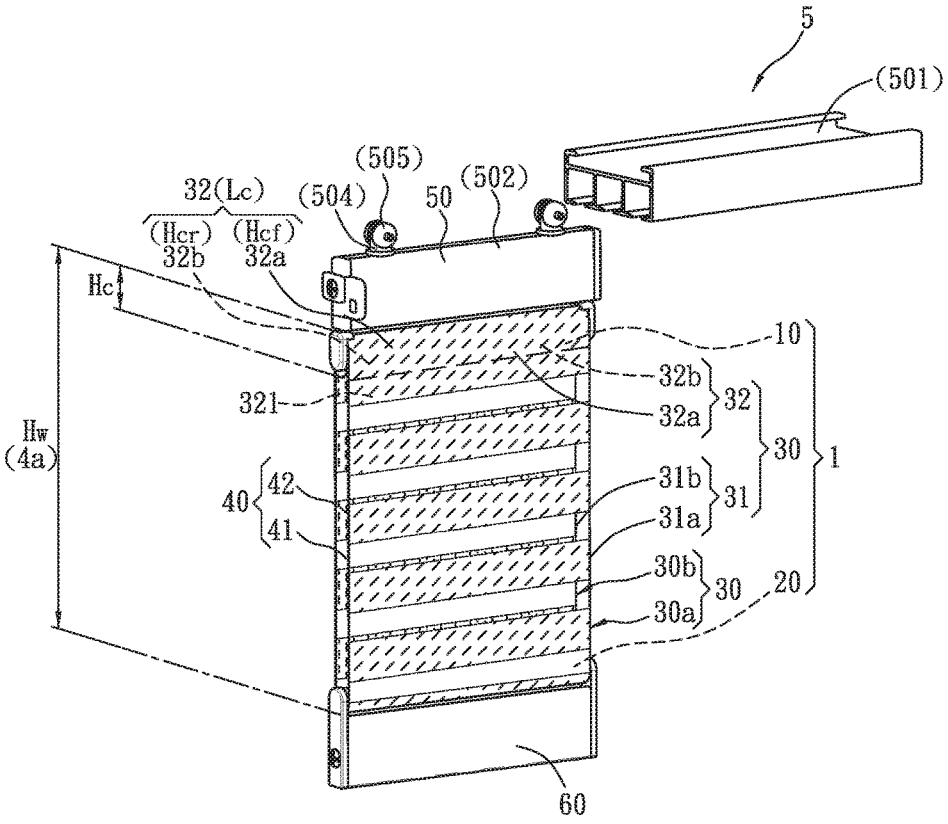
FIG. 4 is a perspective view of the embodiment in FIG. 3 according to the present invention.
Figure 5:
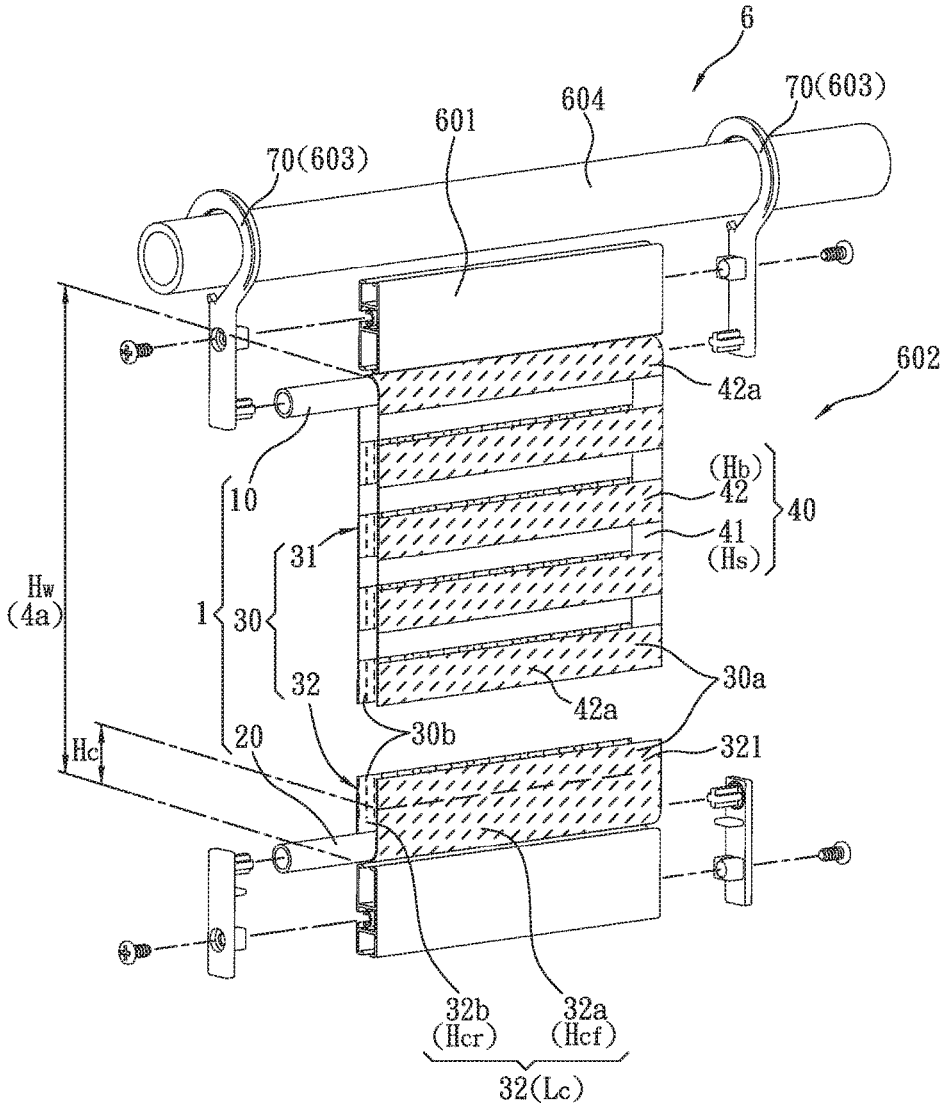
FIG. 5 is an explosive view of an embodiment applied to a hooked type curtain according to the present invention.
Figure 6:
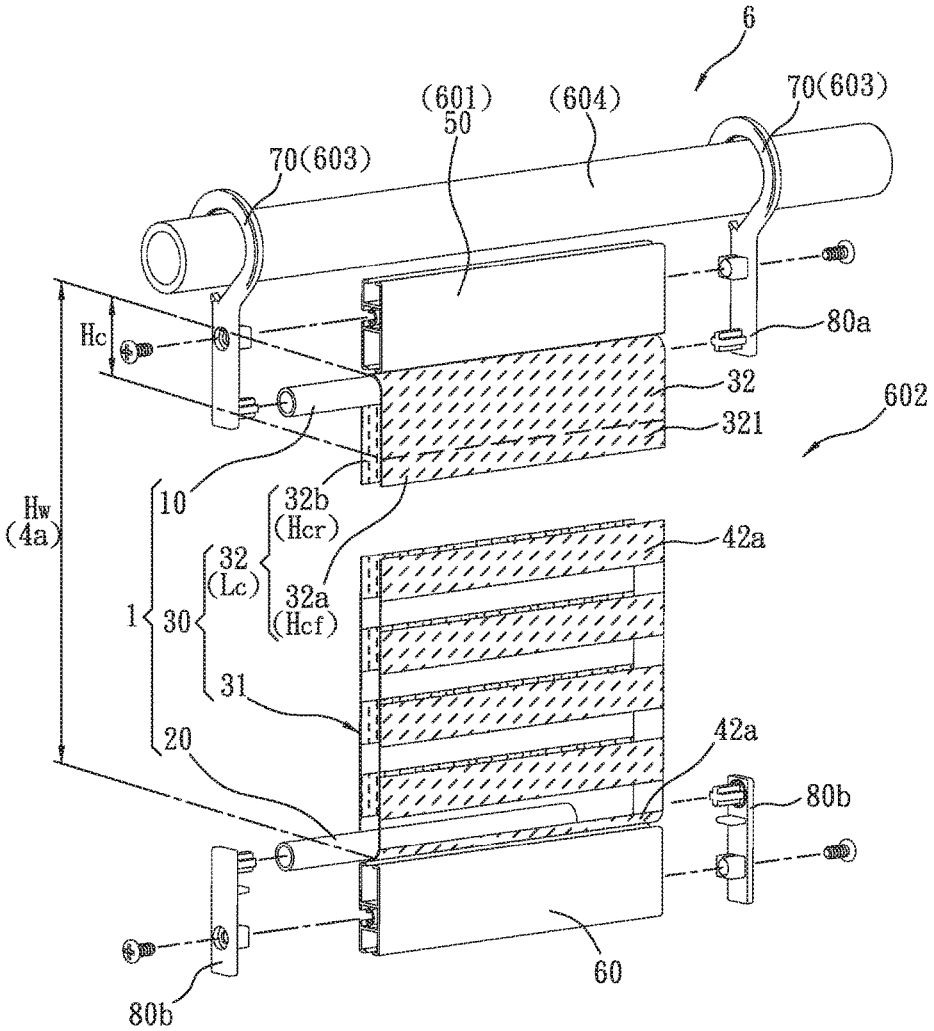
FIG. 6 is a perspective view of the embodiment in FIG. 5 according to the present invention.

Refer from FIG. 1 to FIG. 4, a looped zebra blind 1 with height compensation of the present invention is used for covering a window 4 and is designed into a sliding panel 5 while in use. Or the looped zebra blind 1 with height compensation can be designed into a hooked curtain 6, as shown in FIG. 5 and FIG. 6.

Figure 1:
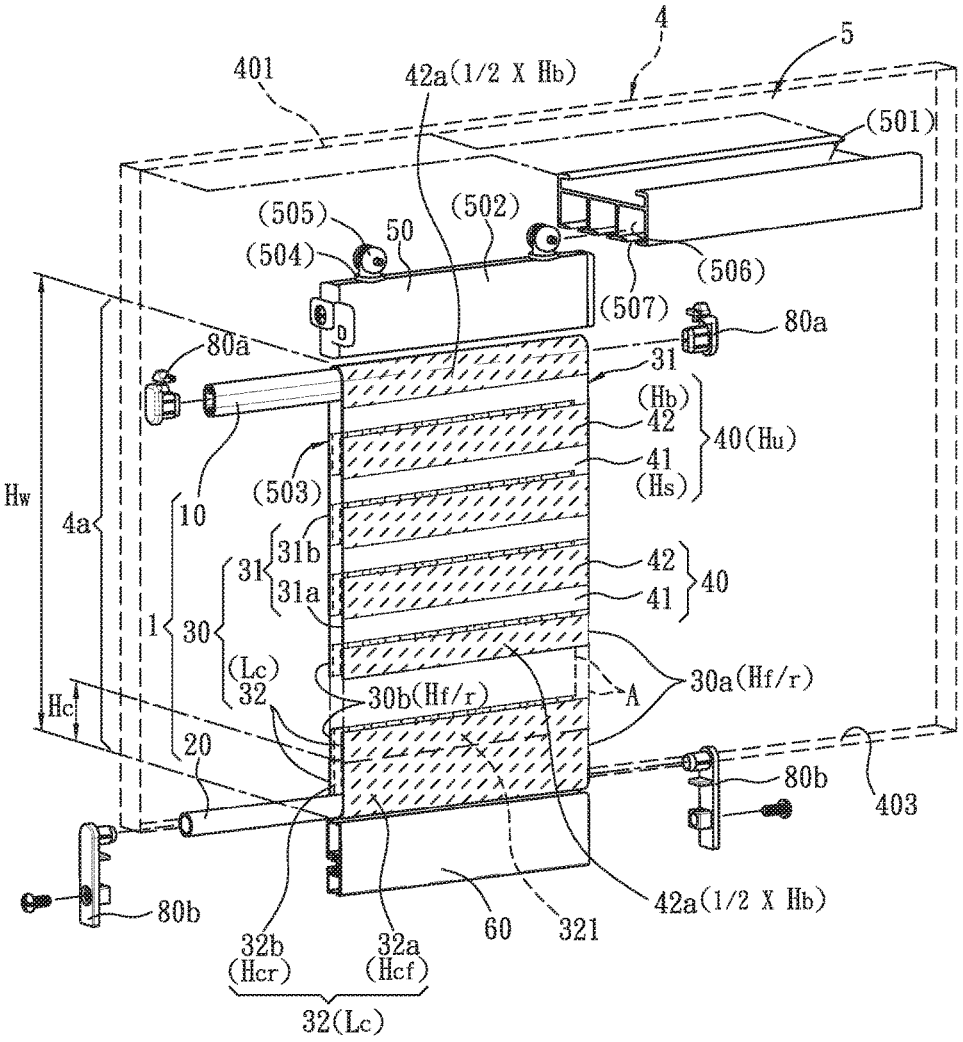
FIG. 1 is an explosive view of an embodiment applied to a sliding panel and having a compensation part wound around a lower rod and separated from a zebra fabric part according to the present invention.
Figure 2:
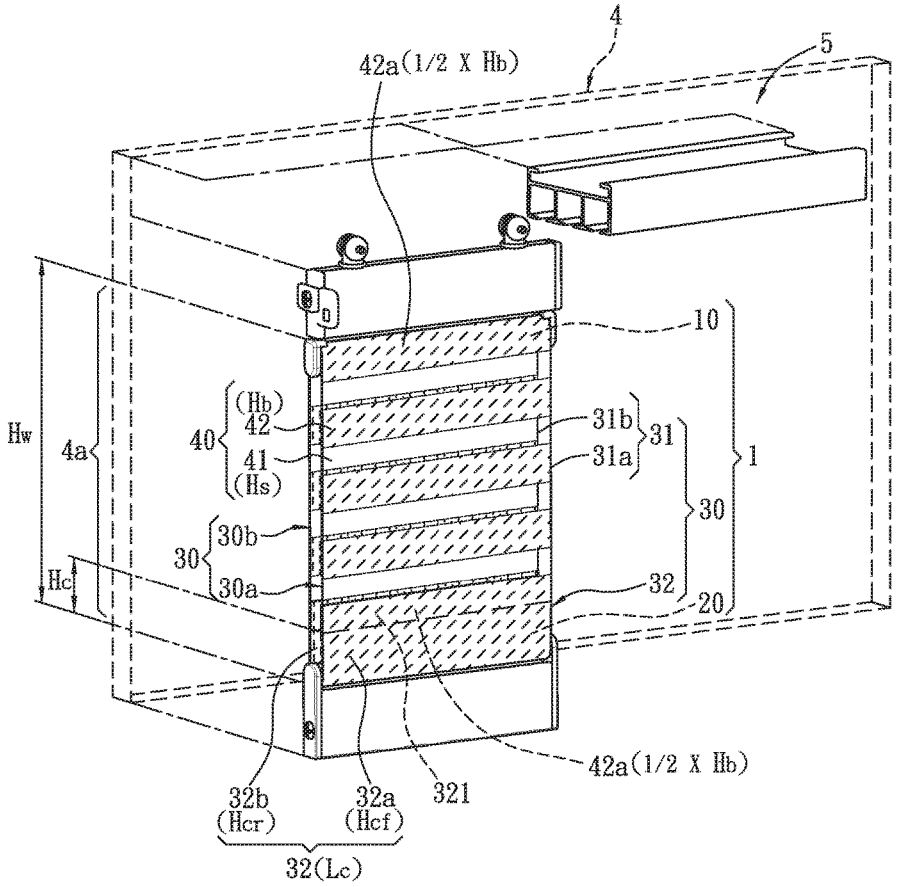
FIG. 2 is a perspective view of the embodiment in FIG. 1 according to the present invention (having the zebra fabric part and the compensation part connected together)

The looped zebra blind 1 of the present invention mainly includes an upper rod 10, a lower rod 20 and a looped fabric 30. The upper rod 10 is disposed on or close to an upper edge 401 of the window 4 such as an inner or outer side of a frame on the upper edge 401 of the window 4, as shown in FIG. 1. The lower rod 20 is arranged at or close to a lower edge 403 of the window 4 and corresponding to the upper rod 10 vertically. The looped fabric 30 is for covering a preset covered area 4*a* of the window 4. The preset covered area 4*a* is completely shaded by the looped fabric 30. The looped zebra blind 1 of the present invention is assembled with other components such as loading mechanisms or operation mechanism to form a zebra blind. It can be designed into a sliding panel 5, as shown in FIG. 1 and FIG. 2, or a hooked curtain 6, as shown in FIG. 5 and FIG. 6. Thus the preset covered area 4*a* is having a preset height, represented by Hw. Generally, Hw is a bit shorter than the total height of the window 4. That means the preset height of the preset covered area 4*a* Hw is obtained by the height of other components such as upper track and/or lower tract (501, 50, 60 as shown in FIG. 1) being deducted from the total height of the window 4.

Figure 11:
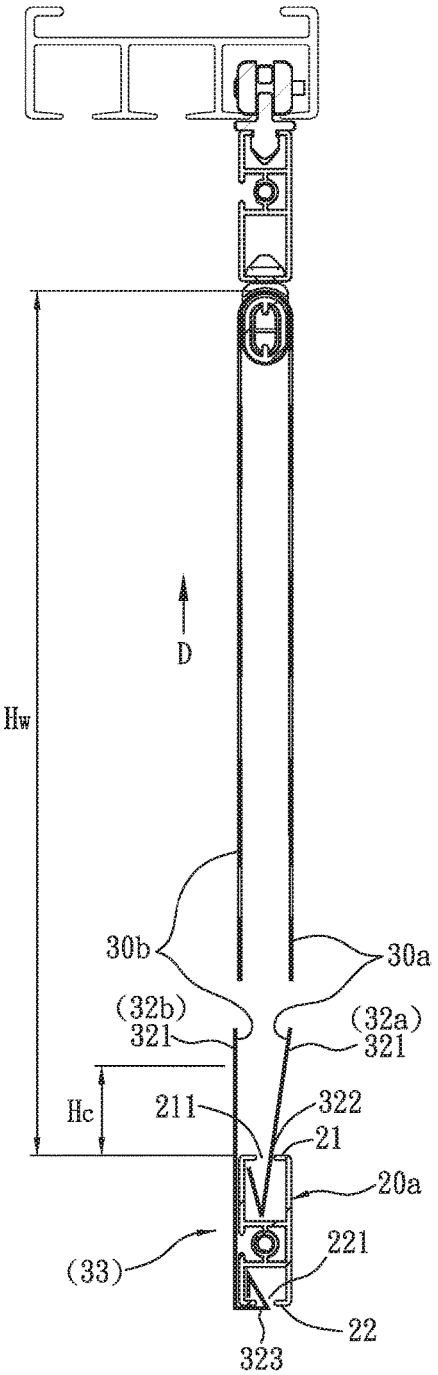
FIG. 11 and FIG. 12 are schematic drawings showing a cross sectional view of an embodiment having a looped fabric around an aluminum extrusion frame used as a lower rod according to the present invention.
Figure 12:
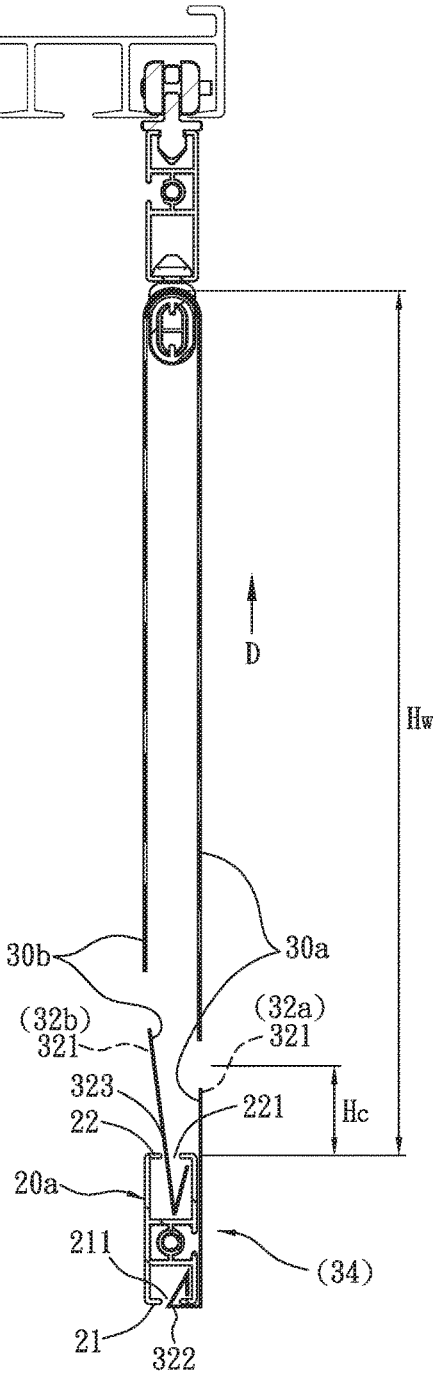

As shown from FIG. 1 to FIG. 4, the looped fabric 30 of the present invention consists of a zebra fabric part 31 and a compensation part 32 for height compensation. The zebra fabric part 31 is formed by a plurality of zebra fabric units 40 arranged periodically and vertically. The zebra fabric part 31 is connected to at least one compensation part 32 to form a full-loop as shown from FIG. 1 to FIG. 10 or a semi-loop, as shown in FIG. 11 and FIG. 12. The loop/semi-loop is wound around the upper rod 10 and the lower rod 20 to form a front fabric 30*a* and a rear fabric 30*b* with the same height (Hw or $H_{f/r}$), arranged vertically and corresponding to each other.

Each zebra fabric unit 40 includes a see-through segment 41 and an opaque segment 42 with proper height and adjacent to each other. In a common zebra fabric unit 40, the height of the see-through segment 41Hs is 5 cm (Hs=5 cm) while the height of the opaque segment 42 Hb is 7.5 cm (Hb=7.5 cm). Thus the height of the zebra fabric unit 40Hu is 12.5 cm (Hu=Hs+Hb=12.5 cm).

The compensation part 32 forms but not limited to an opaque area. That means the compensation part 32 is made from the same material and having the same structure as the opaque segment 42.

The net length of the compensation part 32 is represented by Lc, which is predetermined after calculation. Thus the total length of the looped fabric 30 is equal to the sum of the length of the zebra fabric part 31 and the net length of the compensation part 32 Lc. Thus the height of the front/rear fabric 30*a*/30*b* $H_{f/r}$ is nearly a half of the total length of the looped fabric 30. Thereby the height $H_{f/r}$ of the front/rear fabric 30*a*, 30*b* matches up to the preset height of the preset covered area 4*a* Hw after height compensation. That means $H_{f/r}$=Hw and the looped fabric 30 covers the preset covered area 4*a* completely. When the front fabric 30*a* or the rear fabric 30*b* is pulled upward or downward, the overlapping between the see-through segments 41 and the opaque segments 42 of the front and the rear fabric 30*a*, 30*b* is adjusted by the synchronous movement between the front fabric 30*a* and the rear fabric 30*b* after height compensation, without changing the height $H_{f/r}$ (Hw) of the front and the rear fabric 30*a*, 30*b*. Thus the opacity of the looped zebra blind 1 in relative to the window 4 is adjustable.

The net length of the compensation part 32 Lc of the looped zebra blind 1 shown in FIG. 1 to FIG. 4 is given by following equation:

$$Lc=2Hw-[Hu\times(N-n)], Lc=Hcf+Hcr, \text{ and } Hu=Hb+Hs;$$

wherein Lc is the net length of the compensation part 32, Hw represents a preset height of a preset covered area 4*a* of the window that is completely covered by the looped fabric, Hu is the height of the zebra fabric unit 40, N is a whole number in a ratio of 2Hw to Hu (2Hw/Hu), n is a whole number and representing the ratio of the net length of the compensation part 32 Lc to the length of the looped fabric 30, N>n≥0, Hcf is the net height of a front compensation part 32*a* on the front fabric 30*a* (a part of Lc on the front fabric 30*a*), Hcr is the net height of a rear compensation part 32*b* on the rear fabric 30*b* (a part of Lc on the rear fabric 30*b*), Hb is the height of the opaque segment 42 of the zebra fabric unit 40, and Hs is the height of the see-through segment 41 of the zebra fabric unit 40. In the above equation, Lc, Hw and Hu have the same length unit. In the equation, the length of the looped fabric 30 wound around the upper rod 10 and the lower rod 20 after height compensation is considered to be negligible. Thus the net length of the compensation part 32 Lc is the sum of the net height of the front compensation part 32*a* Hcf and the net height of the rear compensation part 32*b* Hcr. Lc=Hcf+Hcr.

As shown in the figures, when the ratio of Lc to the total length of the looped fabric 30 (2Hw) is reduced, Lc, Hcf, or Hcr is also reduced relatively. Thus the effect of the compensation part 32 on the appearance of the zebra fabric part 31 is reduced significantly.

In an embodiment of the present invention, Lc=Hcf+Hcr, wherein Hcf is no less than Hcr (Hcf≥Hcr). Thus the rear compensation part 32*b* with the net height of Hcr is shaded by the front compensation part 32*a* with the net height of Hcf. While in use, the rear compensation part 32*b* of the looped zebra blind 1 of the present invention is unable to be seen clearly from the front end of the looped zebra blind 1. This also minimizes the effect of the compensation part 32 on the appearance of the looped zebra blind 1.

The front compensation part 32*a* (the net height Hcf) and the rear compensation part 32*b* (the net height Hcr) are connected integratedly, wound around/near the lower rod 20 and located on a lower part of the front/rear fabric 30*a*, 30*b*, as shown in FIG. 1 and FIG. 2. Or the front compensation part 32*a* (the net height Hcf) and the rear compensation part 32*b* (the net height Hcr) are wound around/near the upper rod 10 and located on an upper part of the front/rear fabric 30*a*, 30*b*, as shown in FIG. 3 and FIG. 4. Or the front compensation part 32*a* and the rear compensation part 32*b* are separated from each other and located on other positions of the front/rear fabric 30*a*, 30*b*, except the upper part and the lower part (not shown in figure) at the height corresponding to each other such as a middle part of the front fabric 30*a* or the rear fabric 30*b* shown in FIG. 1 and FIG. 2.

In an embodiment of the present invention, while giving Lc by the equation Lc=2Hw−[Hu×(N−n)], n can be either 0 or 1. Thus Lc, Hcf, or Hcr is increased or decreased relatively. When n is getting larger, Lc, Hcf, or Hcr is increased. On the other hand, Lc, Hcf, or Hcr is decreased while n is getting smaller. Thereby the effect of the compensation part 32 on the appearance of the looped fabric 30 is reduced.

The connection between the compensation part 32 and the zebra fabric part 31 is achieved by connecting techniques available now such as adhesion by glue, sewing, or high-frequency/ultrasonic welding. The two ends of the compensation part 32 are respectively connected to the two ends of the zebra fabric part 31 to form a looped fabric 30, as the connecting line A indicated in FIG. 1. Refer to FIG. 1, an overlapping segment 321 occurs while connecting the compensation part 32 and the zebra fabric part 31. The size/height of the overlapping segment 321 depends on strength requirements of the connection way or requirements of the specification. Yet the height of the overlapping segment 321 is not included in Lc (Hcf, Hcr).

In an embodiment, the compensation part 32 and the zebra fabric part 31 are connected by knitting technique. One side of the zebra fabric part 31 is knitted to extend outward to form the compensation part 32. Then the other end of the compensation part 32 is connected to the other side of the zebra fabric part 31 by connecting techniques available now to form a looped fabric 30. The height of the overlapping segment 321 generated due to connection between the compensation part 32 and the zebra fabric part 31 is not included in Lc (Hcf, Hcr).

In the embodiment of the present invention shown from FIG. 1 to FIG. 4, the zebra fabric part 31 can be formed by an even-number multiple of zebra fabric units 40 (Hu), but not limited. Thus the height of a front and a rear zebra fabric parts 31*a*, 31*b* connected to each other between the upper rod 10 and the lower rod 20 is also a whole-number multiple of the height Hu. In order to make the production of the looped fabric 30 become more convenient, it is set that Hcf is equal to Hcr (Hcf=Hcr). Thus the net height of the compensation part 32 Hc is equal to Hcf and Hcr (Hc=Hcf=Hcr). And Lc is given by following equation:

$$Lc=2\times Hc; Hc=Hw-[Hu\times(N'-n')]; Hu=Hb+Hs; \text{ and } Hc=Hcf=Hcr;$$

wherein Lc is the net length of the compensation part 32, Hc is the net height of the compensation part 32, Hw represents a preset height of a preset covered area 4*a* of the window 4 that is completely covered by the looped fabric, Hu is the height of the zebra fabric unit 40, Hb is the height of the opaque segment 42 of the zebra fabric unit 40, and Hs is the height of the see-through segment 41 of the zebra fabric unit 40. In the equation, Hc, Hw and Hu have the same length unit. N' is a whole number in the ratio of Hw to Hu (Hw/Hu), n' is the ratio of the net length of the compensation part 32 Lc to the length of the looped fabric 30 and is a whole number, N'>n'≥0. In the above equation, the length of the looped fabric 30 wound around the upper rod 10 and the lower rod 20 is considered to be negligible. Thus Lc=Hcf+Hcr=Hc+Hc=2Hc (Lc=2×Hc). During manufacturing process, Lc is calculated simply, but not limited to such calculation.

In the above embodiment, the zebra fabric part 31 is formed by an even-number multiple of the zebra fabric units 40 (Hu). Thus the height of the front and the rear zebra fabric parts 31*a*, 31*b* connected to each other between the upper rod 10 and the lower rod 20 is also a whole-number multiple of the height Hu. Take the embodiment in FIG. 1 as an example. When the zebra fabric part 31 is wound around the upper rod 10, an opaque segment 41 of a zebra fabric unit 40 (Hu) of the zebra fabric part 31 is arranged to be wound around and disposed on the upper rod 10 and the height of the opaque segment 41 Hb is divided into two parts. One half-height part 42*a* (with the height of ½×Hb) is kept on a top end of the front zebra fabric part 31*a* while the other half-height part 42*a* is kept on a top end of the rear zebra fabric part 31*b* (as the top end of the zebra fabric part 31 shown in FIG. 1). After the zebra fabric part 31 being formed and divided into a front fabric part 31*a* and a rear fabric part 31*b*, the two bottom ends of the zebra fabric part 31 also include a half-height part 42*a* that is a half of the height of the opaque segment 41 Hb (the height of 42*a*=½×Hb) (as the bottom end of the zebra fabric part 31 shown in FIG. 1). The side (rear end) of the two bottom ends of the zebra fabric part 31 (half-height part 42*a*) are respectively connected to two sides/ends of the compensation part 32 (as connecting line A indicated in FIG. 1). Thus the height of the front and rear fabric parts 31*a*, 31*b* is a whole-number multiple of the height of the zebra fabric unit 40 (Hu). Thereby the durability, lifetime and efficiency of the looped fabric 30 are improved. Moreover, when the compensation part 32 is wound around the lower rod 20, it is also present at a lower part of the front/or rear fabric 30*a*, 30*b*, as shown in FIG. 1 and FIG. 2. Similarly, the compensation part 32 of the embodiment in FIG. 3 and FIG. 4 is present at an upper part of the front/or rear fabric 30*a*, 30*b*.

According to the above description, it is learned that the height of the front and rear fabric parts 31*a*, 31*b* is not guaranteed to be a whole-number multiple of the height of the zebra fabric units 40 Hu when Lc is given by the equation Lc=2Hw−[Hu×(N−n)] and the integral number N is an integer, not limited to odd or even number. Once N is an odd number, while being divided into two halves, the height of the front fabric part 31*a* and the height of the rear fabric part 31*b* are not a whole-number multiple of the height Hu. Once Lc is given by the equations Hc=Hw−[Hu×(N'−n')] and Lc=2×Hc (N' is an integral number and not limited to odd or even number), the height of the front/rear fabric part 31*a*, 31*b* is just a whole-number multiple of the height of the zebra fabric units 40 Hu. Under the condition with the same preset height Hw, Lc given by the equation Lc=2Hw−[Hu×(N−n)] is smaller than Lc obtained by the equation Hc=Hw−[Hu×(N'−n')]. In practice, manufacturers can get the net length Lc of the compensation part 32 by selecting different equations according to the requirements of the looped fabric 30.

In other words, Lc is given by the equation Lc=2Hw−[Hu×(N−n)] is based on the condition that the total length of the looped fabric 30 is two times of the Hw and Lc=Hcf+Hcr. As to Lc obtained by the equation Hc=Hw−[Hu×(N'−n')] and Lc=2×Hc, it is based on the condition that the net height $H_{f/r}$ of the front/rear fabric 30*a*, 30*b* is equal to Hw ($H_{f/r}$=Hw) and Hc=Hcf=Hcr. Thus the later condition calculated by the equation Hc=Hw−[Hu×(N'−n')] can be considered as an embodiment of the former calculated by the equation Lc=2Hw−[Hu×(N−n)]. In a word, refer to FIG. 1 to FIG. 4, the net length Lc of the compensation part 32 of the present invention can be considered as two times of the net height Hc of the compensation part 32. Lc=2Hc. Lc can be given by different equations first and then the half of Lc is Hc. Or Hc is calculated first and then Hc is doubled to get Lc.

As shown in FIG. 1 to FIG. 6, when at least one overlapping segment 321 is generated due to connection between the compensation part 32 (32*a*, 32*b*) and the zebra fabric part 31 (31*a*, 31*b*), the position of the overlapping segment 321 can be changed according to the requirement of connection way or the appearance. In the figures, the overlapping segment 321 is arranged at a rear end of the compensation part 32 (32*a*, 32*b*), but not limited. The overlapping segment 321 can also be disposed on the zebra fabric part 31 (31*a*, 31*b*) (not shown in figure). Or the overlapping segment 321 can be divided into two parts arranged at the compensation part 32 (32*a*, 32*b*) and the zebra fabric part 31 (31*a*, 31*b*) respectively. During manufacturing processes, the size of the compensation part 32 (32*a*, 32*b*) and/or the zebra fabric part 31 (31*a*, 31*b*) may be modified. No matter which position the overlapping segment 321 is located at, the net length Lc or net height Hc(Hcf, Hcr) of the compensation part 32 is defined and calculated by the original equations.

In the embodiment of FIG. 1 to FIG. 4, an upper rod support 50 is disposed on an edge 401 of an upper end of the window 4. Thus the left and right sides of the upper rod 10 are assembled with the upper rod support 50 by other assembly elements 80*a*. Thus the net height of the looped fabric 30 (net height $H_{f/r}$ of the front/rear fabric 30*a*, 30*b*) matches up to the preset height Hw so as to shade the preset covered area 4*a* completely.

The present invention further includes a lower rod support 60. The lower rod support 60 is arranged at an edge 403 of a lower end of the window 4. Thus the left and right sides of the lower rod 20 are mounted in the lower rod support 60 by other assembly elements 80*b*. Thus the net height of the looped fabric 30 (net height $H_{f/r}$ of the front/rear fabric 30*a*, 30*b*) matches up to the preset height Hw so as to shade the preset covered area 4*a* completely.

In the embodiment of FIG. 1 to FIG. 4, the upper rod support 50 is in the form of a carrier track (502) of a sliding panel 5. Thus the looped zebra blind 1 of the present invention becomes a panel (503) of the sliding panel 5. But the upper rod support 50 is not limited to the carrier track (502). It can be designed into different structures and used in combination with elements of different blinds/curtains so that the present invention has wide applications.

In an embodiment of FIG. 5 and FIG. 6, the upper rod support 50 is disposed with at least one hook 70 used to hang the looped zebra blind 1 on a curtain rod 604 so that the looped zebra blind 1 is used like a curtain. The hook 70 can also be designed into different structure and used in combination with elements of different blinds/curtains so that there are more applications.

Figure 7:
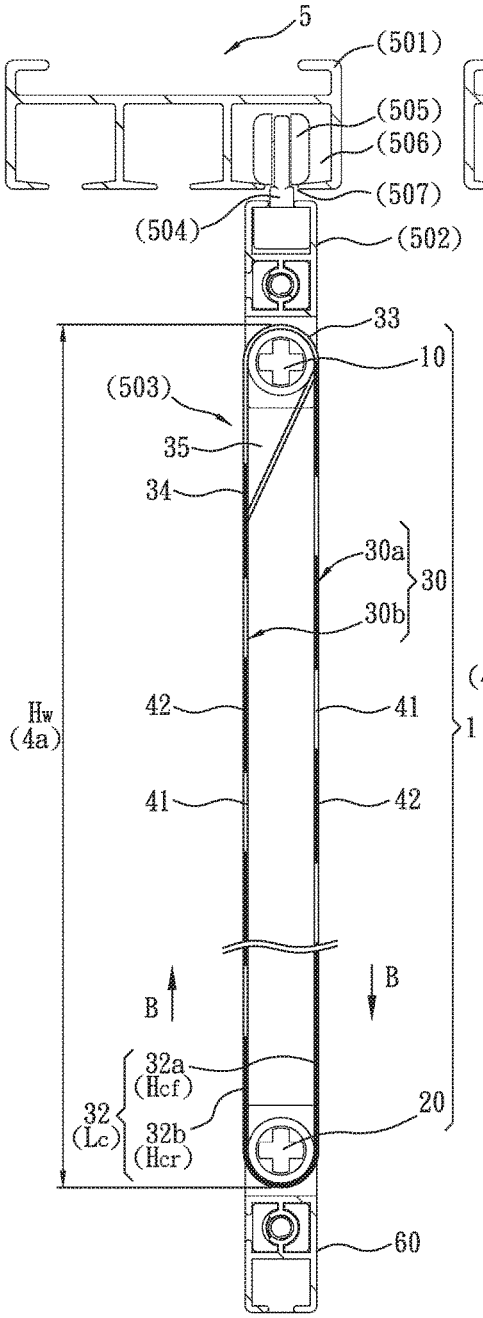
FIG. 7 and FIG. 8 are schematic drawings showing a cross sectional view of an embodiment having a front and a rear stopping points (a small circle) at a looped fabric around an upper rod according to the present invention.
Figure 8:
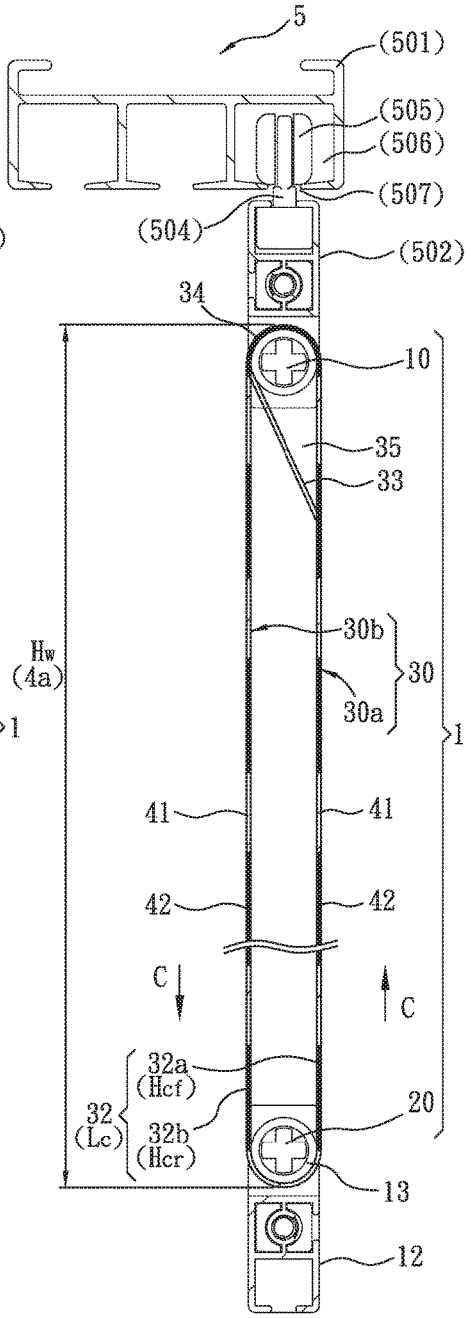

While in use, the front fabric 30*a* or the rear fabric 30*b* is pulled upward or downward, overlapping of the see-through parts 41 and the opaque parts 42 of the front/rear fabric 30*a*, 30*b* can be adjusted by synchronous and relative movement between the front fabric 30*a* and the rear fabric 30*b* after height compensation without changing the height of the front/rear fabric 30*a*, 30*b*, as shown in FIG. 7 and FIG. 8. The shading of the window 4 by the looped zebra blind 1 is adjusted.

A height compensation method of looped zebra blinds according to the present invention includes following steps:

Step 1: Measure a preset height Hw of a preset covered area 4*a* of a window 4;

Step 2: Provide a looped zebra blind 1 including an upper rod 10, a lower rod 20 and a height compensable looped fabric 30. The looped fabric 30 consists of a zebra fabric part 31 and a compensation part 32. The zebra fabric part 31 is formed by a plurality of zebra fabric units 40 arranged vertically and periodically. The zebra fabric part 31 and the compensation part 32 are connected to form a loop wound around the upper rod 10 and the lower rod 20 vertically and the loop having a front fabric 30*a* and a rear fabric 30*b* with the same height and corresponding to each other. The zebra fabric unit 40 is formed by a see-through part 41 and an opaque part 42 adjacent to each other and having certain height. The compensation part 32 forms an opaque area, but not limited.

Step 3: Calculate and set the net length Lc of the compensation part 32 so as to make the total length of the looped fabric 30 become equal to the sum of the total length of the zebra fabric part 31 and the net length Lc of the compensation part 32. Thus the net height of the front fabric 30*a* and the rear fabric 30*b* formed matches up to the preset height Hw after height compensation.

Step 4: Connect the compensation part 32 with the net length Lc and the zebra fabric part 31 to form the looped fabric 30.

Step 5: Wind the looped fabric 30 around/on to the upper rod 10 and the lower rod 20 vertically to form the front fabric 30*a* and the rear fabric 30*b* having the same height, corresponding to each other and located between the upper rod 10 and the lower rod 20. Thus a height compensable looped zebra blind 1 is produced.

In the step 3 of setting the net length Lc of the compensation part 32, the net length Lc of the compensation part 32 is calculated and given by following equation: $Lc=2Hw-[Hu\times(N-n)]$, $Lc=Hcf+Hcr$, and $Hu=Hb+Hs$. The definition of each parameter is as mentioned above.

Moreover, in the step 3 of setting the net length Lc of the compensation part 32, the net length Lc of the compensation part 32 is also calculated and given by following equation: $Hc=Hw-[Hu\times(N'-n')]$, $Hu=Hb+Hs$, $Hc=Hcf=Hcr$ and $Lc=2\times Hc$. The definition of each parameter is mentioned above.

Figure 9:
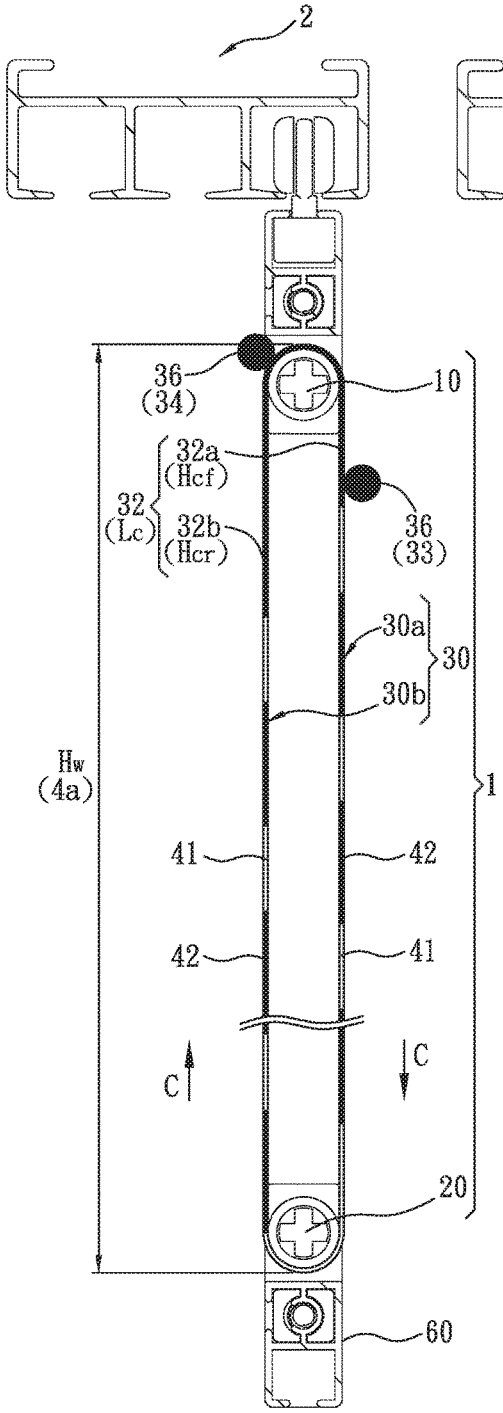
FIG. 9 and FIG. 10 are schematic drawings showing a cross sectional view of an embodiment having a front and a rear stopping points (a front and a rear stopping strips) at a looped fabric around an upper rod according to the present invention.
Figure 10:
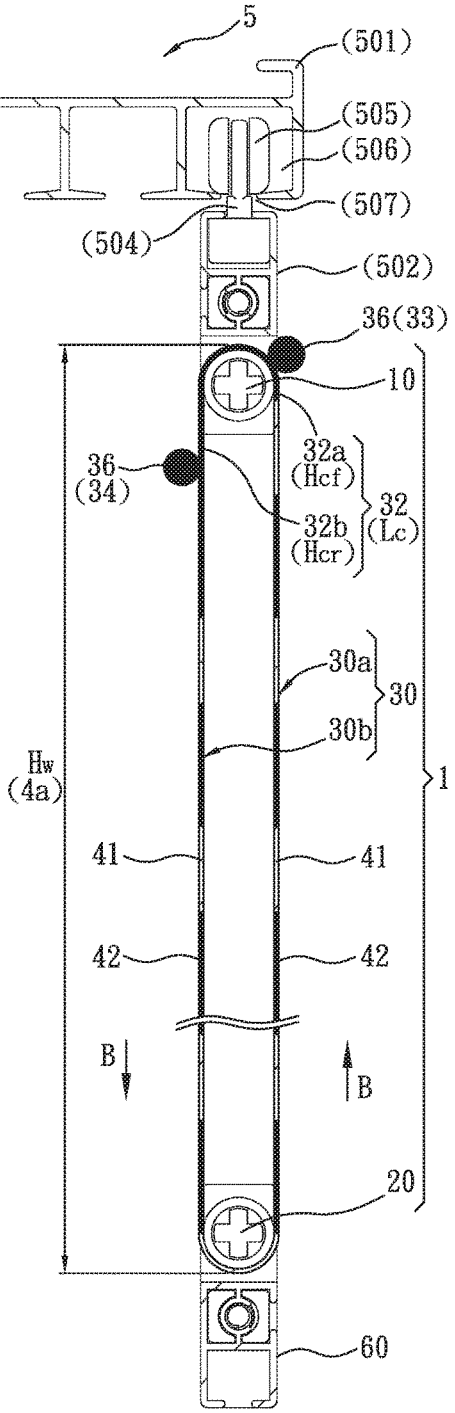

Refer from FIG. 7 to FIG. 10, a front stopping point 33 and a rear stopping point 34 are arranged at the position where the looped fabric 30 is around the upper rod 10 or the lower rod 20 so as to restrict the vertical movement (height) of the front fabric and the rear fabric 30*a*, 30*b* while being pulled for adjusting the shading of the window. The position of the compensation part 32 (32*a*, 32*b*) and the position of the zebra fabric part 31 (31*a*, 31*b*) on the front fabric and the rear fabric 30*a*, 30*b* are not limited. The compensation part 32 (32*a*, 32*b*) can be disposed on the bottom of the front fabric and the rear fabric 30*a*, 30*b*, as shown in FIG. 7 and FIG. 8, or on the top of the front fabric and the rear fabric 30*a*, 30*b*, as shown in FIG. 9 and FIG. 10. The size of the compensation part 32 (32*a*, 32*b*) is not given in the actual scale.

As shown in FIG. 7 and FIG. 8, the distance between the front stopping point and the rear stopping point 33, 34 is set as a length unit of vertical movement of the front and the rear fabric 30*a*, 30*b* in relative to each other during adjustment of the opacity. That's the minimum vertical movement of the length. When the looped fabric 30 is moved (as an arrow B indicated in FIG. 7) and stopped at the front stopping point 33, the opaque parts 42 of the front fabric 30*a* and the see-through parts 41 of the rear fabric 30*b* are overlapped correspondingly to form a shading state, as shown in FIG. 7 (but not limited). While the looped fabric 30 is moved in opposite direction (as an arrow C indicated in FIG. 8) and stopped at the other stopping point (rear stopping point) 34, the see-through parts 41 of the front fabric 30*a* and the see-through parts 41 of the rear fabric 30*b* are overlapped correspondingly to form a see-through state (but not limited). Thereby the front fabric 30*a* or the rear fabric 30*b* is pulled downward or upward between the two stopping points 33, 34 to move at the minimum vertical movement of the length for adjusting opacity of the looped zebra blind 1.

Refer to FIG. 7 and FIG. 8, the front and the rear stopping points 33, 34 are formed by a small circle 35. The small circle 35 is formed by the looped fabric 30 further wound again near the upper rod 10. When the front fabric 30*a* and the rear fabric 30*b* of the looped fabric 30 are moved vertically in relative to each other and two ends of the small circle 35 are stopped on the upper rod 10, the looped fabric 30 stops moving. Thereby the front and the rear stopping points 33, 34 provide the stopping function.

Refer to FIG. 9 and FIG. 10, the front and the rear stopping points 33, 34 are formed by a stopping strip (or stopping block) 36 respectively. A stopping strip (or stopping block) 36 is arranged at the front side and the rear side of a part of the looped fabric 30 that is around the upper rod 10. Thereby the looped fabric 30 is stopped by the stopping strip (or stopping block) 36 when the front fabric 30*a* and the rear fabric 30*b* of the looped fabric 30 are moved vertically in relative to each other. Thus the stopping function as the front and the rear stopping points 33, 34 provided in FIG. 7 and FIG. 8 is achieved.

Refer to FIG. 11 and FIG. 12, under the condition that the net length Lc or the net height Hc of the compensation part 32 is fixed at a preset value, the bottom of the compensation part 32 further includes two bottom ends 322, 323 with different height, a high bottom end 322 and a low bottom end 323. The lower rod 20 in FIG. 1 to FIG. 10 is replaced by a lower rod 20*a* having an upper groove 211 and a lower groove 221. The lower rod 20*a* can be an aluminum extrusion frame with a rectangular cross section. The upper groove 211 and the lower groove 221 are respectively located on a top surface 21 and a bottom surface 22 of the lower rod 20*a*. Thus the two bottom ends 322, 323 with different height are respectively fixed in the upper groove 211 and the lower groove 221. After height compensation, the front and the rear fabric 30*a*, 30*b* are straight in the vertical direction due to the load of the lower rod 20*a*, as shown in FIG. 11. And the top surface 21 (rectangular cross section) of the lower rod 20*a* is at an upper position while the rectangular bottom surface 22 (rectangular cross section) is at a lower position. When the rear fabric 30*b* is pulled upward (as an arrow D indicated in FIG. 11), the lower rod 20*a* turns and becomes upside down, as shown in FIG. 12. The top surface 21 (rectangular cross section) is changed to the lower position while the rectangular bottom surface 22 (rectangular cross section) is at the upper position. When the rear fabric 30*b* is pulled in an opposite direction, the same condition occurs. Moreover, when the height difference between the top surface 21 and the bottom surface 22 of the lower rod 20*a* is set the same as the distance between two ends of the small circle 35 in FIG. 7 and FIG. 8, the lower rod 20*a* will stay at the straight and vertical state as shown in FIG. 11 and FIG. 12 after operation. Thus the looped fabric 30 stops moving. The lower rod 20*a* achieves the stopping function like the stopping points 33, 34 shown in FIG. 7 and FIG. 8 or the stopping strip (block) 36 shown in FIG. 9 and FIG. 10.

Compared with conventional looped type zebra blinds, the present invention has following features and advantages:

1. The looped type zebra blind such as full-looped revealed in DE 20 2007 008111 U1. EP 11 171 809.4 or semi-looped disclosed in WO 2007/085533 (PCT/EP2007/050265), GB2,253,000, both have the problem that the height of the front fabric or the rear fabric $H_{f/r}$ is unable to match up a preset height Hw of a preset covered area of the window during manufacturing or in use. The looped zebra blind with height compensation of the present invention provides a technical solution to solve the above problem.

2. The technical solution to for the above problem is not only easy to be applied to manufacturing of the looped zebra blind for preventing trouble and inconvenience during manufacturing but the design is also helpful in the appearance of the looped zebra blind.

3. The looped zebra blind with height compensation of the present invention increases the applications and value of the zebra blinds. Thus consumers have more choices.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A looped zebra blind with height compensation and used to cover a window comprising:

an upper rod that is disposed on or close to an upper edge of the window;

a lower rod that is arranged at or close to a lower edge of the window and corresponding to the upper rod;

a looped fabric that is used for covering a preset covered area of the window and having a zebra fabric part and at least one to compensation part connected to each other so as to form a loop wound around the upper rod and the lower rod vertically while the loop having a front fabric and a rear fabric with a same height and corresponding to each other; the zebra fabric part including a plurality of zebra fabric units arranged vertically and periodically; wherein each zebra fabric unit is formed by a see-through part and an opaque part adjacent to each other and with certain height;

wherein a net length of the compensation part is calculated and set in advance to make a total length of the looped fabric become equal to a sum of the total length of the zebra fabric part and a net length of the compensation part; and the height of the front fabric or the rear fabric is almost equal to a half of the total length of the looped fabric after height compensation; thereby the height of the front fabric or the rear fabric matches up to a preset height of the preset covered area of a window; the preset covered area is completely shaded by the looped fabric;

wherein when the front fabric or the rear fabric is pulled upward or downward, overlapping of the see-through parts and the opaque parts of the front fabric and the rear fabric is able to be adjusted by synchronous and relative movement between the front fabric and the to rear fabric after height compensation without changing the height of the front fabric and the rear fabric; thus opacity of the looped zebra blind in relative to the window is adjusted, and wherein the net length of the compensation part is given by the following equations:

$$Lc=2Hw-[Hu\times(N-n)];Lc=Hcf+Hcr;\text{ and }Hu=Hb+Hs;$$

wherein Lc is the net length of the compensation part, Hw represents preset height of the preset covered area of the window that is completely covered by the looped fabric, Hu is a height of the zebra fabric unit, N is a whole number in a ratio of 2Hw to Hu (2Hw/Hu), n is a whole number and representing a range of the net length of the compensation part Lc in the looped fabric, N>n≥0, Hcf is a net height of a front compensation part that is a part of the compensation part on the front fabric, Hcr is the net height of a rear compensation part that is a part of the compensation part on the rear fabric, Hb is a height of the opaque part of the zebra fabric unit, and Hs is a height of the see-through part of the zebra fabric unit; Lc, Hw and Hu have the same length unit;

wherein a length of the looped fabric wound around the upper rod and the lower rod after height compensation is considered to be negligible;

wherein the net length of the compensation part Lc includes the net height of the front compensation part Hcf on the front fabric and the net height of the rear compensation part Hcr on the rear fabric, Lc=Hcf+Hcr.

2. The device as claimed in claim 1, wherein the front compensation part on the front fabric and the rear compensation part on the rear fabric are connected integratedly, wound around or near the lower rod or the upper rod, and located on a lower part or an upper part of the front fabric or the rear fabric; or the front compensation part and the rear compensation part are separated from each other and located on other positions of the front fabric or the rear fabric except the upper part and the lower part respectively.

3. The device as claimed in claim 1, wherein the zebra fabric part is formed by an even-number multiple of zebra fabric units so that height of the front fabric and the rear fabric that are connected to each other and between the upper rod and the lower rod is a whole-number multiple of the height of the zebra fabric unit.

4. The device as claimed in claim 1, wherein the net length of the compensation part is given by the following equations:

$$Lc=2\times Hc;Hc=Hw-[Hu\times(N'-n')];Hc=Hcf=Hcr;\text{ and }Hu=Hb+Hs;$$

wherein Lc is the net length of the compensation part, Hc is a net height of the compensation part, Hw represents a preset height of a preset covered area of the window that is completely covered by the looped fabric, Hu is the height of the zebra fabric unit, Hb is the height of the opaque part of the zebra fabric unit, and Hs is the height of the see-through part of the zebra fabric unit; Hc, Hw and Hu have the same length unit; N' is a whole number in a ratio of Hw to Hu (Hw/Hu), n' is a range of the net length of the compensation part Lc in the looped fabric and is a whole number, N'>n'≥0; Hcf is the net height of a front compensation part that is a part of the compensation part on the front fabric; Hcr is the net height of the rear compensation part that is a part of the compensation part on the rear fabric;

wherein when the net height of the front compensation part on the front fabric Hcf is equal to the net height of the rear compensation part on the rear fabric Hcr (Hcf=Hcr), a half of the net length of the compensation part Lc is equal to the net height of the compensation part Hc, Lc=2×Hc, and Hc=Hcf=Hcr;

wherein the length of the looped fabric wound around the upper rod and the lower rod after height compensation is considered to be negligible in the equations.

5. The device as claimed in claim 4, wherein when the zebra fabric part is wound around the upper rod, an opaque part of a zebra fabric unit of the zebra fabric part is arranged to be wound around and disposed on the upper rod and the height of the opaque part is divided into two parts; one half-height part is kept on a top end of the front zebra fabric part while another half-height part is kept on a top end of the rear zebra fabric part; after the zebra fabric part being formed and divided into a front fabric part and a rear fabric part, two bottom ends of the zebra fabric part also include a half-height part that is a half of the height of the opaque part; one side of the two bottom ends of the zebra fabric part are respectively connected to two sides of the compensation part; thus the height of the front fabric part and the rear fabric part is a whole-number multiple of the height of the zebra fabric unit.

6. The device as claimed in claim 4, wherein when the zebra fabric part is wound around the lower rod, an opaque part of a zebra fabric unit of the zebra fabric part is arranged to be wound around and disposed on the lower rod and the height of the opaque part is divided into two parts; one half-height part is kept on a bottom end of the front zebra fabric part while the other half-height part is kept on a bottom end of the rear zebra fabric part; after the zebra fabric part being formed and divided into a front fabric part and a rear fabric part, two top ends of the zebra fabric part also include a half-height part that is a half of the height of the opaque part; one side of the two top ends of the zebra fabric part are respectively connected to two sides of the compensation part; thus the height of the front fabric part and the rear fabric part is a whole-number multiple of the height of the zebra fabric unit.

7. The device as claimed in claim 1, wherein the compensation part and the zebra fabric part are connected by glue, sewing, high-frequency welding or ultrasonic welding; thus two ends of the compensation part are connected to two ends of the zebra fabric part so as to form the looped fabric; wherein an overlapped part between the compensation part and the zebra fabric part connected to each other is not included in the net length of the compensation part.

8. The device as claimed in claim 1, wherein a front stopping point and a rear stopping point are arranged at positions where the looped fabric is around the upper rod or the lower rod so as to restrict vertical movement of the front fabric and the rear fabric.

9. The device as claimed in claim 8, wherein a distance between the front stopping point and the rear stopping point is set as a length unit of vertical movement of the front fabric and the rear fabric in relative to each other during adjustment of shading; when the looped fabric is moved and stopped at one of the stopping points, the opaque parts of the front fabric and the see-through parts of the rear fabric are overlapped correspondingly to foul' a shading state; while the looped fabric is moved and stopped at the other stopping point, the see-through parts of the front fabric and the see-through parts of the rear fabric are overlapped correspondingly to form a see-through state, thereby the front fabric or the rear fabric is pulled downward or upward between the two stopping points so as to adjust opacity of the looped zebra blind.

10. The device as claimed in claim 1, wherein the lower rod is an aluminum extrusion frame with a rectangular cross section and having an upper groove and a lower groove located on a top surface and a bottom surface thereof respectively; under the condition that the net length or the net height of the compensation part is fixed at a preset value, the bottom of the compensation part further includes two bottom ends with different height, a high bottom end and a low bottom end; the high bottom end and the low bottom end are fixed in the upper groove and the lower groove respectively; after height compensation, the front and the rear fabric are straight in the vertical direction due to load of the lower rod and the top surface is at an upper position while the bottom surface is at a lower position; when the rear fabric is pulled upward, the lower rod turns and becomes upside down; the top surface is changed to the lower position while the rectangular bottom surface is at the upper position; when height difference between the top surface and the lower surface of the lower rod is set, the top surface of the lower rod stays at the upper position or turns to the lower position after operation so as to make the looped fabric stop moving.

11. A height compensation method of a height compensable looped zebra blind for covering a window comprising the steps of:

Step 1: measuring a preset height of a preset covered area of a window;

Step 2: providing a looped zebra blind including an upper rod, a lower rod and a height compensable looped fabric; the looped fabric having a zebra fabric part and at least one compensation part connected to each other so as to form a loop wound around the upper rod and the lower rod vertically while the loop having a front fabric and a rear fabric with the same height and corresponding to each other; the zebra fabric part including a plurality of zebra fabric units arranged vertically and periodically; the zebra fabric unit having a see-through part and an opaque part adjacent to each other and with certain height;

Step 3: setting the net length of the compensation part so as to make the total length of the looped fabric become equal to the sum of the total length of the zebra fabric part and the net length of the compensation part; thus the net height of the front fabric and the rear fabric matches up to the preset height after height compensation;

Step 4: connecting the compensation part with the net length set and the zebra fabric part having a plurality of zebra fabric units arranged vertically and periodically to form the looped fabric;

Step 5: winding the looped fabric around the upper rod and the lower to rod vertically to form the front fabric and the rear fabric having the same height as the height of the preset height and corresponding to each other; thus production of a height compensable looped zebra blind is completed.

* * * * *